US012600533B2

(12) United States Patent
Zhang

(10) Patent No.: US 12,600,533 B2
(45) Date of Patent: Apr. 14, 2026

(54) STORAGE BOX WITH DOOR LOCK

(71) Applicant: Hangzhou Yixiang Technology Research and Development Co., Ltd., Hangzhou (CN)

(72) Inventor: Tongyi Zhang, Hangzhou (CN)

(73) Assignee: Hangzhou Yixiang Technology Research and Development Co., Ltd., Hangzhou (CN)

( * ) Notice: Subject to any disclaimer, the term of this patent is extended or adjusted under 35 U.S.C. 154(b) by 10 days.

(21) Appl. No.: 18/830,422

(22) Filed: Sep. 10, 2024

(65) Prior Publication Data

US 2025/0128860 A1 Apr. 24, 2025

(30) Foreign Application Priority Data

Oct. 24, 2023 (CN) ..... 202322863636.6

(51) Int. Cl.
*B65D 43/22* (2006.01)
*B65D 43/16* (2006.01)

(52) U.S. Cl.
CPC ..... *B65D 43/22* (2013.01); *B65D 43/166* (2013.01)

(58) Field of Classification Search
CPC ..... B65D 43/22; B65D 43/166; A47J 36/10
USPC ..... 220/315, 4.28, 324; 206/1.5
See application file for complete search history.

(56) References Cited

U.S. PATENT DOCUMENTS 1,818,454 A * 8/1931 Berger ..... A45D 40/221 220/DIG. 26
5,040,834 A * 8/1991 Kahl ..... E05C 3/048 292/205
2006/0169695 A1* 8/2006 Roesler ..... B25H 3/003 220/835
2009/0114653 A1* 5/2009 Schenker ..... B65D 25/32 220/789
2015/0203269 A1* 7/2015 Semer ..... B65D 51/28 206/1.5

* cited by examiner

*Primary Examiner* — Jeffrey R Allen

(57) ABSTRACT

Disclosed is a storage box with a door lock, including a cover and a main body, where the cover is rotatably connected with the main body, and the main body supports the cover. The cover has an open state and a closed state. The storage box further includes a locking mechanism, the locking mechanism is mounted on the cover, the locking mechanism is provided with an unlocking position and a locking position, and the locking mechanism slides or rotates between the unlocking position and the locking position. When the cover is in the closed state and the locking mechanism is at the locking position, the cover and the main body are fixed to each other. When the locking mechanism is at the unlocking position, the cover is switched between the open state and the closed state. The storage box of the present disclosure is easily locked and unlocked.

6 Claims, 5 Drawing Sheets

STORAGE BOX WITH DOOR LOCK

CROSS REFERENCE TO RELATED APPLICATIONS

The present application claims the benefit of Chinese Patent Application No. 202322863636.6 filed on Oct. 24, 2023, the contents of which are incorporated herein by reference in their entirety.

TECHNICAL FIELD

The present disclosure relates to the technical field of storage boxes, and more specifically and particularly relates to a storage box with a door lock.

BACKGROUND

Generally, storage boxes are also known as sorting boxes or containing boxes, and are usually provided with seal covers. The storage boxes are oil-resistant, easy to clean and neatly stacked, and have high load-bearing strength, which brings great convenience to our life. The storage boxes in the prior art are provided with electronic locks or mechanical locks. However, it is difficult to unlock the electronic locks due to electrical faults. The mechanical locks can be opened only through keys, and the keys are carried inconveniently and easily lost, thereby failing to meet contemporary demands for convenient living. Therefore, it is necessary to provide a new door lock device that is easily locked and unlocked.

SUMMARY

To overcome the defects in the prior art, an objective of the present disclosure is to provide a storage box with a door lock structure that is easily locked and unlocked.

To achieve the above objective, the present disclosure proposes a storage box with a door lock. The storage box includes a cover for closing a top of the storage box and a main body for closing a middle and a bottom of the storage box, where the cover is rotatably connected with the main body, and the main body supports the cover. The cover has an open state and a closed state relative to the main body. The storage box further includes a locking mechanism, the locking mechanism is mounted on the cover, the locking mechanism is provided with an unlocking position and a locking position, and the locking mechanism is capable of sliding or rotating between the unlocking position and the locking position. When the cover is in the closed state and the locking mechanism is at the locking position, the cover and the main body are fixed to each other. When the locking mechanism is at the unlocking position, the cover is capable of switching between the open state and the closed state.

The locking mechanism includes an operation panel, a first connecting part and a second connecting part, where the operation panel, the first connecting part and the second connecting part are integrated through injection molding, the first connecting part and the second connecting part are located on a same side of the operation panel, and the first connecting part is located above the second connecting part.

The cover further includes a first mounting part, the first mounting part is in fit with the first connecting part, and the first connecting part slides or rotates on the first mounting part.

The first mounting part includes a mounting groove, a first groove wall and a second groove wall, the first connecting part is at least partially located in the mounting groove, the first groove wall is located above the mounting groove, the second groove wall is located below the mounting groove, and the first groove wall and the second groove wall are arranged opposite to each other.

A sliding rail is arranged on the first groove wall, a top wall of the first connecting part located in the mounting groove is arranged opposite to the first groove wall, the top wall of the first connecting part comprises a sliding groove, an opening of the sliding groove faces the first groove wall, and the sliding rail is at least partially accommodated in the sliding groove.

A bottom wall of the first connecting part located in the mounting groove is arranged opposite to the second groove wall, the bottom wall of the first connecting part comprises support protrusions, and the support protrusions abut against the second groove wall.

The locking mechanism further includes the second connecting part, the main body further includes a second mounting part, and the second mounting part and the main body are fixed to each other; and when the locking mechanism is at the locking position, the second mounting part is located between the second connecting part and the second groove wall, and the second groove wall is located between the second mounting part and the first connecting part.

The second mounting part further includes a fixing hole, the second connecting part further comprises a protruding portion, the protruding portion is in fit with the fixing hole, and when the locking mechanism is at the locking position, the protruding portion is at least partially located in the fixing hole.

When the locking mechanism is at the unlocking position, the second mounting part is disengaged from a position from between the second connecting part and the second groove wall.

Beneficial Effects

It can be seen from the above technical solution that, compared with the prior art, the present disclosure has the following advantages:

1. The locking and unlocking between the cover and the main body are realized by sliding or rotating the locking mechanism, which facilitates user operation and significantly enhances the convenience of locking and unlocking the storage box.
2. A sliding rail structure of the first mounting part and a sliding groove structure of the first connecting part enable the locking mechanism to be securely fixed on the first mounting part of the cover, and the locking mechanism can only slide on the first mounting part for locking and unlocking, thereby reducing the likelihood of losing the locking mechanism after unlocking.
3. The support protrusions are arranged on the bottom wall of the first connecting part, and the support protrusions abut against the second groove wall, which reduces the likelihood of friction between an entire bottom surface of the first connecting part and the second groove wall during sliding, thereby improving the smoothness of sliding of the locking mechanism.

REFERENCE NUMERALS IN FIGURES

1—cover; 11—first mounting part; 111—mounting groove; 112—first groove wall; 1121—sliding rail; 113—second groove wall; 12—first fixing part; 2—main body; 21—front panel; 211—second mounting part; 2111—fixing hole; 212—second fixing part; 22—rear panel; 3—locking mechanism; 31—first connecting part; 311—sliding groove; 312—support protrusion; 32—second connecting part; 321—protruding portion; and 33—operation panel.

DETAILED DESCRIPTIONS OF THE EMBODIMENTS

The examples of the present disclosure are described clearly and completely below with reference to the accompanying drawings.

Figure 1:
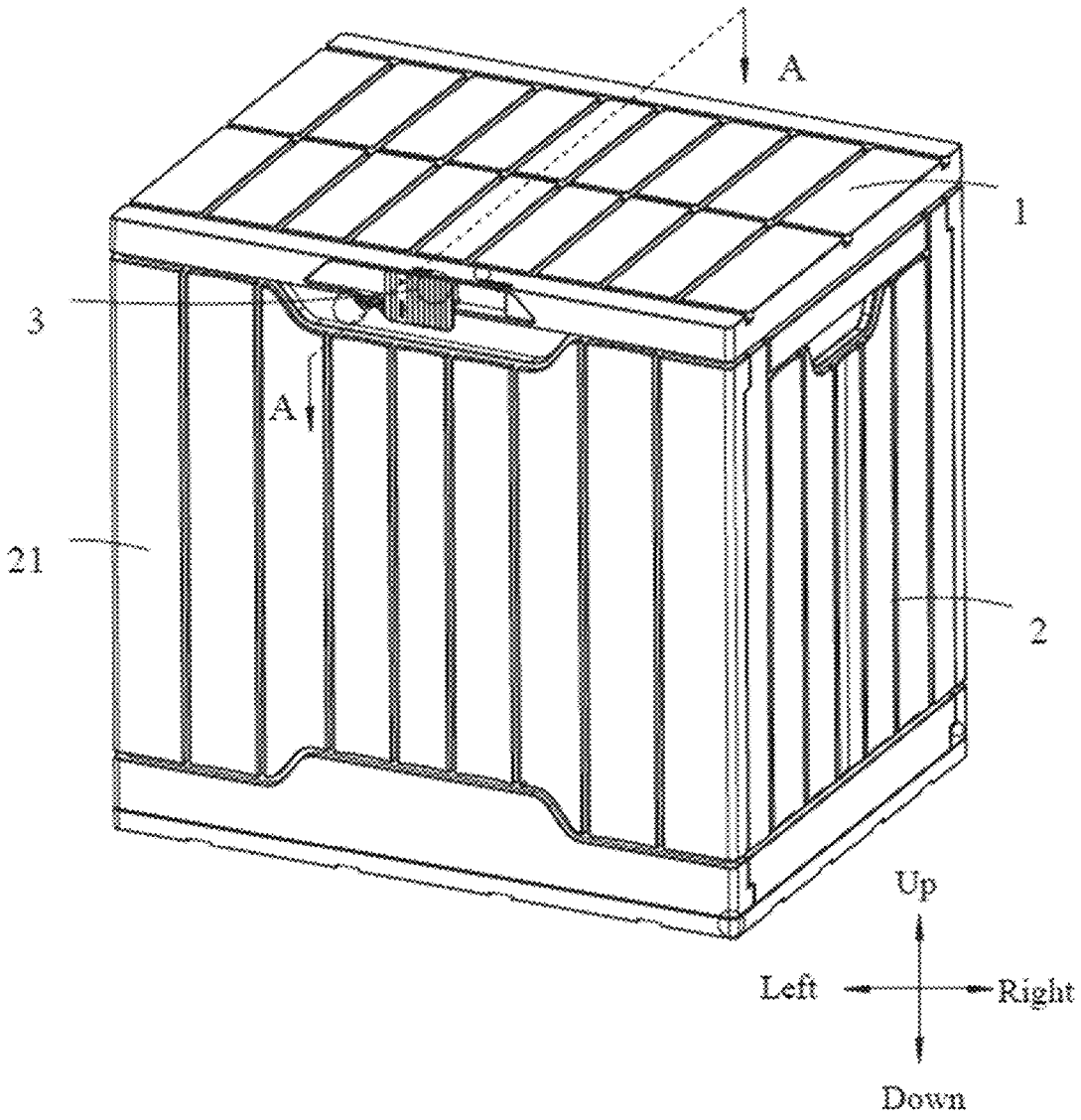
FIG. 1 is a schematic diagram of three-dimensional assembly of a storage box with a cover in a closed state according to an example of the present disclosure.
Figure 2:
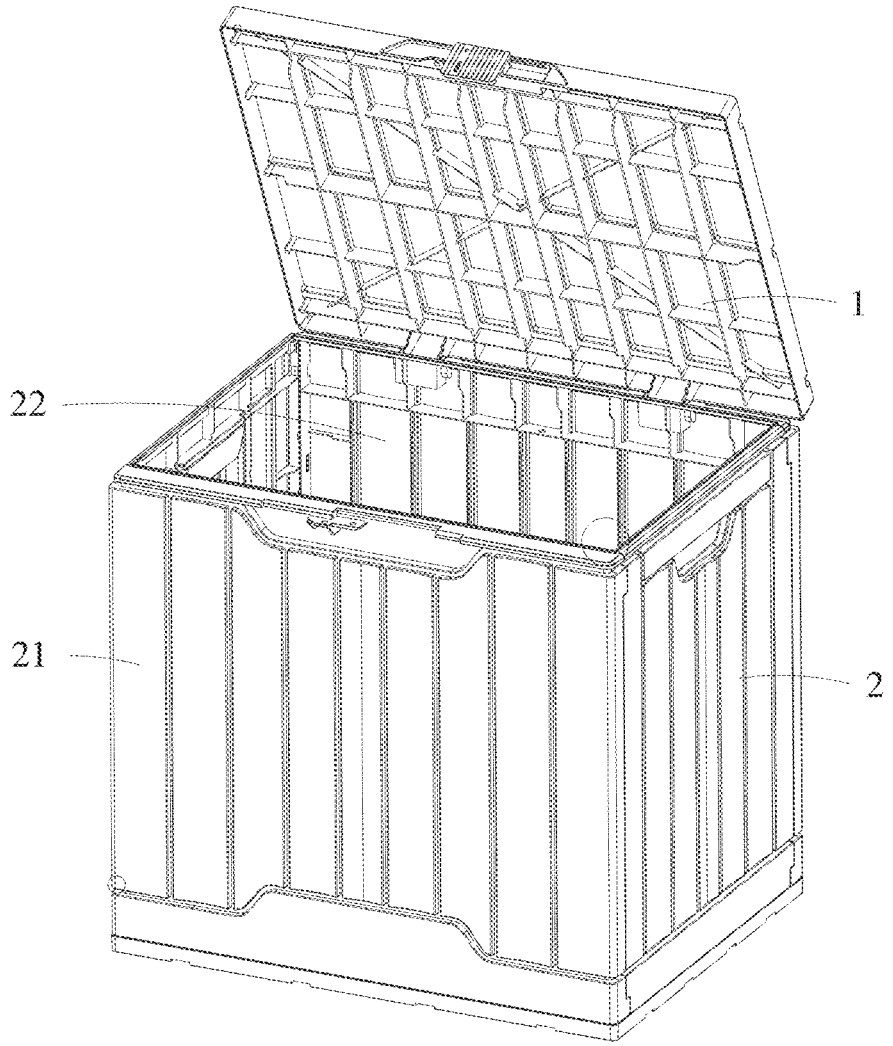
FIG. 2 is a schematic diagram of three-dimensional assembly of a storage box with a cover in an open state according to an example of the present disclosure.
Figure 3:
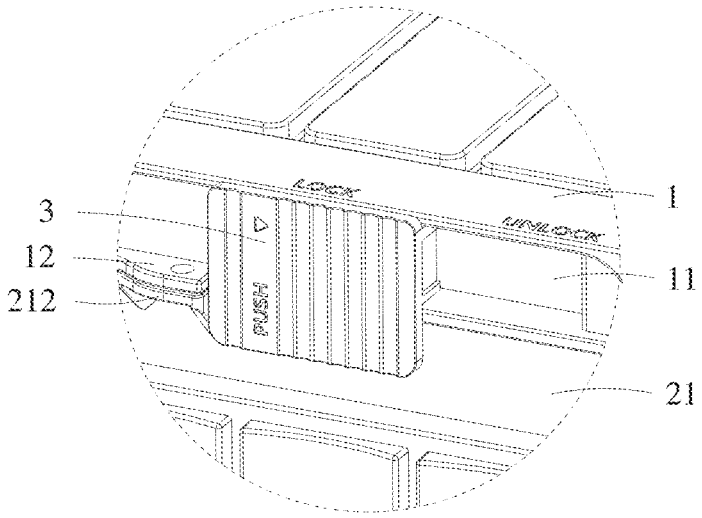
FIG. 3 is a partially enlarged view of a locking mechanism at a locking position according to an example of the present disclosure.
Figure 4:
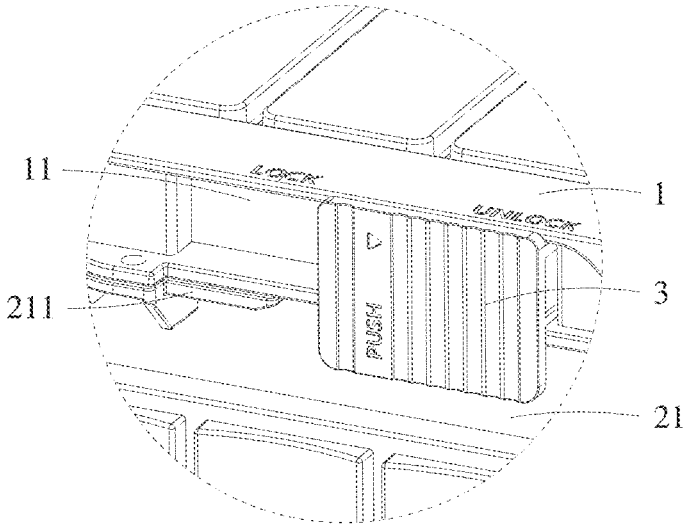
FIG. 4 is a partially enlarged view of a locking mechanism at an unlocking position according to an example of the present disclosure.
Figure 5:
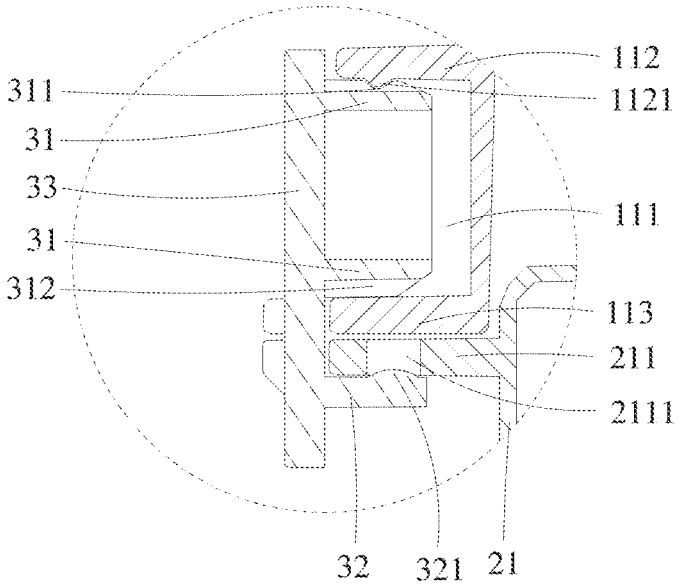
FIG. 5 is a schematic diagram of a partial section of the present disclosure in an A-A direction in FIG. 1.
Figure 6:
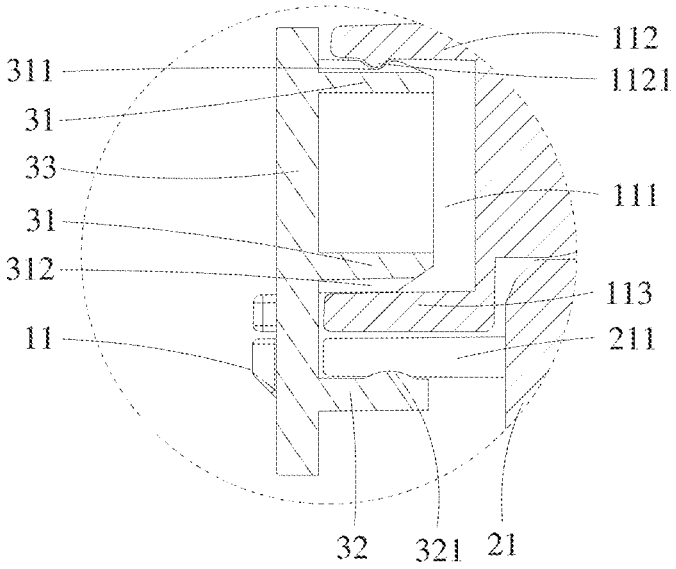
FIG. 6 is a schematic diagram of a partial section of a locking mechanism in an unlocking position according to an example of the present disclosure.
Figure 7:
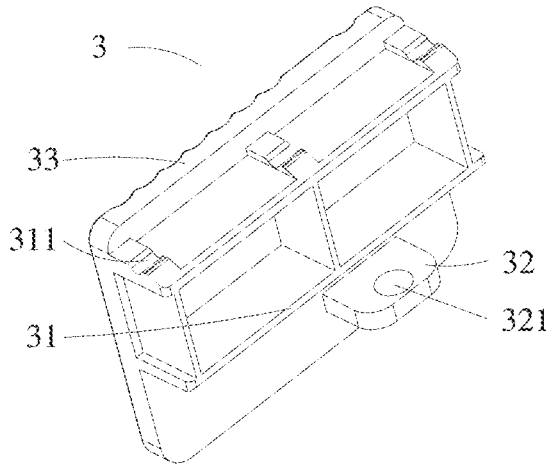
FIG. 7 is a three-dimensional schematic diagram of a locking mechanism according to an example of the present disclosure.
Figure 8:
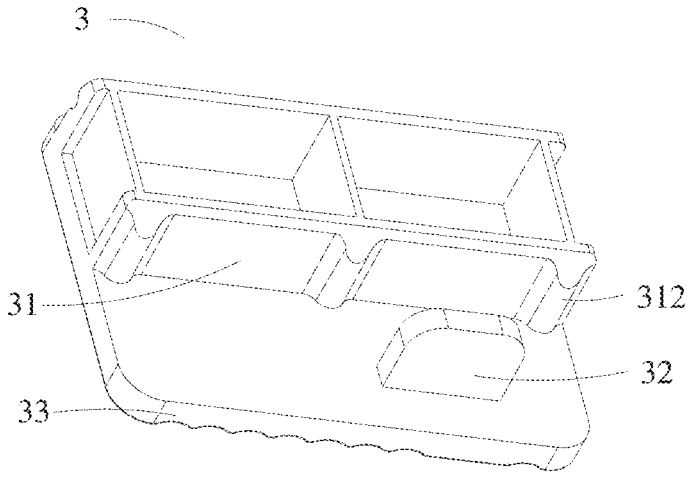
FIG. 8 is a three-dimensional schematic diagram of another view of a locking mechanism according to an example of the present disclosure.

As illustrated in FIGS. 1-8, a storage box with a door lock of the present disclosure includes a cover 1 for closing a top thereof and a main body 2 for closing a middle and a bottom thereof, where the cover 1 and the main body 2 are hingedly connected, i.e., the cover 1 is rotatably connected relative to the main body 2. The cover 1 has an open state and a closed state. When the cover 1 is in the open state, a user can put in or take out an item from inside of the main body 2 through an opening of the main body 2; and when the cover 1 is in the closed state, the cover 1 closes the opening at a top of the main body 2, i.e., the cover 1 closes an opening of the storage box.

The storage box further includes a locking mechanism 3, and the main body 2 includes a front panel 21 and a rear panel 22, where the rear panel 22 is rotatably connected to the cover 1. When the cover 1 is in the closed state, the locking mechanism 3 is capable of locking and unlocking the cover 1 and the front panel 21, i.e., the locking mechanism 3 is provided with an unlocking position and a locking position, and the locking mechanism 3 is capable of sliding or rotating between the unlocking position and the locking position. The locking mechanism 3 is mounted on the cover 1. When the locking mechanism 3 is located at the locking position and the cover 1 is in the closed state, the cover 1 cannot rotate relative to the front panel 21, i.e., the cover 1 cannot be opened; and when the locking mechanism 3 is located at the unlocking position, the cover 1 is capable of rotating relative to the front panel 21 or the main body 2, i.e., the cover 1 is capable of moving between the open state and the closed state.

The cover 1 includes a first mounting part 11, and the first mounting part 11 is configured for supporting and fixing the locking mechanism 3. The locking mechanism 3 is capable of sliding or rotating at a position of the first mounting part 11, such that the locking mechanism 3 moves between the unlocking position and the locking position.

Specifically, the first mounting part 11 includes a first groove wall 112, a second groove wall 113 and a mounting groove 111, where the mounting groove 111 is located between the first groove wall 112 and the second groove wall 113, the first groove wall 112 is located above the mounting groove 111, i.e., the first groove wall 112 is located at a top of the first mounting part 11; and the second groove wall 113 is located below the mounting groove 111, i.e., the second groove wall 113 is located at a bottom of the first mounting part 11. The locking mechanism 3 includes an operation panel 33 and a first connecting part 31. The user can slide or rotate the entire locking mechanism 3 through the operation panel 33. The first connecting part 31 protrudes from the operation panel 33 of the locking mechanism 3, the first connecting part 31 extends or protrudes in a direction from the operation panel 33 to the rear panel 22, the first connecting part 31 is partially or completely located in the mounting groove 111, and the first connecting part 31 is capable of sliding in the mounting groove 111. The operation panel 33 is located at an opening of the mounting groove 111 or outside the opening, and the operation panel 33 partially covers the opening of the mounting groove 111.

A top of the first connecting part 31 is arranged opposite to the first groove wall 112. A plurality of sliding grooves 311 is further formed at the top of the first connecting part 31, and a sliding rail 1121 is arranged on a bottom surface of the first groove wall 112, where the plurality of sliding grooves 311 is in fit with the sliding rail 1121. After the locking mechanism 3 is mounted, the sliding rail 1121 is partially or completely accommodated in the plurality of sliding grooves 311. An opening of the sliding groove 311 faces the first groove wall 112, and the sliding rail 1121 extends in a direction from the first groove wall 112 to the second groove wall 113. A length direction of the sliding rail 1121 is parallel to a surface where a bottom wall of the mounting groove 111 is located, i.e., the length direction of the sliding rail 1121 is parallel to a surface where the front panel 21 is located, and the length direction of the sliding rail 1121 is a direction in which the locking mechanism 3 slides between the unlocking position and the locking position.

A bottom of the first connecting part 31 is arranged opposite to the second groove wall 113. Support protrusions 312 are arranged at the bottom of the first connecting part 31, and the support protrusions 312 extend in a direction from the bottom of the first connecting part 31 to the second groove wall 113. When the locking mechanism 3 is mounted on the cover 1, the support protrusions 312 abut against an inner side of the second groove wall 113, and when the locking mechanism 3 slides horizontally, the support protrusions 312 rub against the second groove wall 113 in a sliding manner. The support protrusions 312 are made of a wear-resistant material, the number of the support protrusions 312 is three, and the three support protrusions 312 are respectively located at a left end, a middle and a right end of the second groove wall 113, to maintain stability of the locking mechanism 3 sliding on the second groove wall 113.

The locking mechanism 3 further includes a second connecting part 32, the second connecting part 32 protrudes from the operation panel 33 of the locking mechanism 3, and the second connecting part 32 extends or protrudes in a direction from the operation panel 33 to the rear panel 22. The locking mechanism 3 is integrated through injection molding, i.e., the operation panel 33, the second connecting part 32 and the first connecting part 31 are integrally formed through injection molding. The first connecting part 31 is located above the second connecting part 32, and the second connecting part 32 is arranged opposite to a surface where the support protrusions 312 on the first connecting part 31 are located.

The second connecting part 32 further includes a protruding portion 321, and the protruding portion 321 protrudes upward, i.e., the protruding portion 321 extends in a direction towards the first connecting part 31. The front panel 21 includes a second mounting part 211, the second mounting part 211 and the front panel 21 are integrated through injection molding, and the second mounting part 211 is located in a front of the front panel 21. When the locking mechanism 3 is at the locking position, the second mounting part 211 and the second connecting part 32 are arranged opposite to each other, and the second connecting part 32 is located below the second mounting part 211, i.e., the second mounting part 211 is located between the first connecting part 31 and the second connecting part 32.

The second mounting part 211 is further provided with a fixing hole 2111, the fixing hole 2111 is in fit with the protruding portion 321. When the locking mechanism 3 is at the locking position, the protruding portion 321 is at least partially located in the fixing hole 2111, such that the locking mechanism 3 is engaged with the second mounting part 211, thereby improving the stability of the locking mechanism 3 at the locking position and reducing the likelihood of opening the locking mechanism 3 in an unintended state.

The cover 1 further includes a first fixing part 12, and the first fixing part 12 is fixedly connected to or integrated with the cover 1 through injection molding. The front panel 21 further includes a second fixing part 212, and the second fixing part 212 is fixedly connected to or integrated with the front panel 21 through injection molding. The first fixing part 12 and the second fixing part 212 are arranged opposite to each other, the first fixing part 12 is located above the second fixing part 212, and both the first fixing part 12 and the second fixing part 212 are provided with through holes. The through holes on the two fixing parts are communicated with and arranged opposite to each other, and locks such as coded locks can be arranged at the through holes to improve the security of the storage box.

When the cover 1 is in the closed state and the locking mechanism 3 is at the locking position, the protruding portion 321 of the locking mechanism 3 is located in the fixing hole 2111, which improves the stability of the locking mechanism 3 at the locking position. Under the action of the first connecting part 31 and the first mounting part 11, the locking mechanism 3 moves with rotation of the cover 1. The second mounting part 211 is located between the second groove wall 113 and the second connecting part 32. In this case, when the cover 1 rotates to the open state, the second connecting part 32 abuts against the second mounting part 211 to prevent the rotation of the cover 1, so as to achieve the locking of the cover 1. When the locking mechanism 3 is at the unlocking position, the second mounting part 211 between the second groove wall 113 and the second connecting part 32 is removed, such that there is no structure capable of preventing the rotation of the cover 1 between the second groove wall 113 and the second connecting part 32, thereby achieving the unlocking of the locking mechanism 3.

Apparently, it should be noted that the terms and descriptions such as "first" and "second" mentioned in the specification and claims herein are used to distinguish different structures, equipment, components and the like, and are not intended to imply any sequential order or limit "first" and "second" as different types. The term "including" is an open-ended term and should be interpreted as "including but not limited to." The term "approximately" or "generally" refers to an acceptable range of error within which those skilled in the art can solve the technical problems and basically achieve the technical effects. Terms such as "connecting", "connection" and "fixing" should be understood in a broad sense. For example, it may be a fixed connection or a detachable connection or integration, where the fixed connection may also be the integration; and it may be a direct connection or an indirect connection via an intermediate medium, unless otherwise expressly limited. For those of ordinary skill in the art, the specific meanings of the above terms in the present disclosure may be understood according to specific circumstances. The term "vertical" mentioned herein should be understood to fall within a range of process errors, or fall within a range of vertical angles from 80° to 100°. The term "parallel" should also be understood to fall within a range of process errors or have a process error of about 10°. The term "and/or" as used in the specification and claims herein refers to and includes any or all possible combinations of one or more of the associated listed items.

Although the examples of the present disclosure have been shown and described above, it can be understood that the foregoing are merely preferred examples of the present disclosure and do not limit the present disclosure in any form. Although the present disclosure has been disclosed in preferred embodiments, they are not intended to limit the present disclosure. Without departing from the scope of the technical solution of the present disclosure, any person skilled in the art may make many possible changes to the technical solution by using the above disclosed technical contents, or modify the technical solution into equivalent examples with equivalent changes. Therefore, any simple alterations, equivalent changes and modifications which are made to the above examples in accordance with the technical essence of the present disclosure without departing from the contents of the technical solution of the present disclosure all fall within the scope of protection of the technical solution of the present disclosure.

What is claimed is:

1. A storage box with a door lock, comprising a cover for closing a top of the storage box and a main body for closing a middle and a bottom of the storage box, wherein the cover is rotatably connected with the main body, and the main body supports the cover; the cover has an open state and a closed state relative to the main body; the storage box further comprises a locking mechanism, the locking mechanism is mounted on the cover, the locking mechanism is provided with an unlocking position and a locking position, and the locking mechanism is capable of sliding between the unlocking position and the locking position; and when the cover is in the closed state and the locking mechanism is at the locking position, the cover and the main body are fixed to each other; and when the locking mechanism is at the unlocking position, the cover is capable of switching between the open state and the closed state;

wherein the locking mechanism comprises an operation panel, a first connecting part, and a second connecting part; the first and second connecting parts being located on a same side of the operation panel, and the first connecting part being located above the second connecting part;

wherein the cover comprises a first mounting part having a mounting groove defined by a first groove wall and a second groove wall that are spaced apart from each other, the first groove wall being located above the mounting groove, the second groove wall being located below the mounting groove, and the first connecting part being slidably mounted in the first mounting part;

wherein a top of the first connecting part is arranged opposite to the first groove wall, a plurality of sliding grooves being provided at the top of the first connecting part, a sliding rail being provided on a bottom surface of the first groove wall, and the sliding rail being slidably accommodated in the plurality of sliding grooves.

2. The storage box with a door lock according to claim 1, wherein the operation panel, the first connecting part and the second connecting part are integrated through injection molding.

3. The storage box with a door lock according to claim 1, wherein a bottom wall of the first connecting part located in the mounting groove is arranged opposite to the second groove wall, the bottom wall of the first connecting part comprises support protrusions, and the support protrusions abut against the second groove wall.

4. The storage box with a door lock according to claim 1, wherein the main body further comprises a second mounting part, and the second mounting part and the main body are fixed to each other; and when the locking mechanism is at the locking position, the second mounting part is located between the second connecting part and the second groove wall, and the second groove wall is located between the second mounting part and the first connecting part.

5. The storage box with a door lock according to claim 4, wherein the second mounting part further comprises a fixing hole, the second connecting part further comprises a protruding portion, the protruding portion is in fit with the fixing hole, and when the locking mechanism is at the locking position, the protruding portion is at least partially located in the fixing hole.

6. The storage box with a door lock according to claim 4, wherein when the locking mechanism is at the unlocking position, the second mounting part is disengaged from a position from between the second connecting part and the second groove wall.

* * * * *